US006196508B1

(12) United States Patent
Nijs

(10) Patent No.: US 6,196,508 B1
(45) Date of Patent: Mar. 6, 2001

(54) BRACKET SYSTEM FOR MOTORIZED AND CRANK OPERATED SHADES

(76) Inventor: Frederik G. Nijs, 229-33rd St. NE., Calgary, Alberta (CA), T2A 4Y6

( * ) Notice: Subject to any disclaimer, the term of this patent is extended or adjusted under 35 U.S.C. 154(b) by 0 days.

(21) Appl. No.: 09/334,268

(22) Filed: Jun. 16, 1999

Related U.S. Application Data

(60) Provisional application No. 60/089,754, filed on Jun. 18, 1998.

(51) Int. Cl.[7] ..... A47H 1/10; A47H 1/13

(52) U.S. Cl. ..... 248/267; 248/268

(58) Field of Search ..... 248/267, 266, 248/269, 342, 343; 242/599.3; 160/133

(56) References Cited

U.S. PATENT DOCUMENTS

| | | | | |
|---|---|---|---|---|
| 1,634,364 | * | 7/1927 | Jakubiec | 248/267 |
| 2,341,217 | | 2/1944 | Holtzclaw . | |
| 2,572,036 | * | 10/1951 | Junkunc | 248/267 |
| 2,614,784 | * | 10/1952 | Nelson | 248/267 |
| 2,651,489 | | 9/1953 | Bell . | |
| 3,430,908 | | 3/1969 | Kowalczyk . | |
| 3,730,469 | | 5/1973 | Shields . | |
| 4,120,474 | | 10/1978 | Hurley . | |
| 4,153,234 | | 5/1979 | Sherwood et al. . | |
| 4,179,091 | | 12/1979 | Bidney . | |
| 4,657,059 | | 4/1987 | Clauss . | |
| 4,930,563 | | 6/1990 | Finch et al. . | |
| 5,474,117 | | 12/1995 | Henkenjohann . | |
| 5,857,653 | * | 1/1999 | Dujlovich | 248/267 |

* cited by examiner

*Primary Examiner*—Ramon O. Ramirez
*Assistant Examiner*—Jerome A. DeLuca

(57) ABSTRACT

The present invention is directed to a shade bracket and shade bracket system that is easy to manufacture, easy to install and easy to adjust to ensure the shade is level. The shade bracket of the present invention comprises a wall or ceiling engaging member and a bracket member having a centrally located cut out portion. The shade bracket provides for the vertical adjustment of a shade roller.

6 Claims, 7 Drawing Sheets

BRACKET SYSTEM FOR MOTORIZED AND CRANK OPERATED SHADES

CROSS-REFERENCE TO RELATED APPLICATIONS

This application claims the benefit of U.S. Provisional Application Ser. No. 60/089,754, filed Jun. 18, 1998.

BACKGROUND OF THE INVENTION

1. Field of the Invention

The present invention is directed to a bracket and a bracket system for motorized and crank operated shades. It allows for simple and quick adjustment and leveling of the shades. It can accommodate a single or dual shade.

2. Description of Related Art

Many shade bracket systems and curtain rod brackets are known in the art. Many include means to level the shade or curtain. For example, U.S. Pat. Nos. 2,651,489 (patentee Kirsch Company, issued Sep. 8, 1953) and 3,430,908 (patentee Walter Kowalczyk, issued Mar. 4, 1969) each disclose a u-shaped support for supporting a curtain rod slidably affixed to a wall bracket. The height and level of the u-shaped support can be adjusted by sliding it along the wall bracket.

Likewise, U.S. Pat. No. 3,730,469 (patentee George Edward Shields, issued May 1, 1973) is directed to an adjustable drapery support with two vertical means for adjustment. It also includes a screw threaded adjustment means. U.S. Pat. No. 2,341,217 (patentee John B Holtzclaw, issued Feb. 8, 1944) is also directed to a drapery holder and discloses an arrangement for supporting dual drapery rods. The rods are vertically adjustable.

The bracket systems and rod holders of the prior art are often complicated and cumbersome devices that are costly to manufacture, difficult to install and difficult to adjust. The bracket system of the present invention overcomes these disadvantages. It is simple and cost effective to manufacture, easy to install and operate.

BRIEF SUMMARY OF THE INVENTION

The preferred form of the invention provides a bracket system for motorized or hand crank operated window shades and blinds. The bracket system includes three different types of brackets. These are adjustable motor brackets, adjustable couple brackets and adjustable end brackets. Each of these brackets may be mounted to a wall, a window support structure or a ceiling depending upon construction site conditions. The shades and blinds are mounted on a typical shade tube or shade roller. If motorized, a tubular motor is mounted within the shade tube.

The bracket system of the present invention comprises one end bracket, one motor bracket and optionally one couple bracket. Each end bracket and each couple bracket have a centrally located cut out portion in which is slidably located a vertically adjustable unshaped support glide. The motor bracket has a centrally located cut out portion. A leveling means extends from the bottom of each end bracket and each couple bracket through the centrally located cut out portion such that the unshaped support glide can be leveled using the leveling means. A leveling means also extends from the bottom of the motor bracket into the centrally located cut out portion. The leveling means is typically a leveling screw.

The three brackets described just above may be used in pairs of a motor bracket and an end bracket at minimum, or the motor bracket and end bracket may be used in combination with one or more couple brackets so that the tubular motor may drive more than one shade. At minimum one motor bracket is secured to the wall, window support structure or ceiling and one end bracket is also secured to the wall, window support structure or ceiling. The shade roller or shade tube is installed between them. A tubular motor is located inside the shade tube with the motor pin (stud) resting on the leveling screw of the motor bracket. An idle end pin of the tubular motor and shade roller system is set into place on the u-shaped support glide of the end bracket. After the shade roller tube is installed the tube is leveled using the leveling screws. That is, the leveling screws are turned up or down to ensure that proper leveling of the shade tube is achieved. Optionally, one or more couple brackets may be installed between the motor bracket and the end bracket so that the motor may drive more than one shade.

DETAILED DESCRIPTION OF THE INVENTION

Each of the three brackets will now be described in detail in conjunction with the attached drawings. Where possible like numerals are used to denote like components.

The brackets described in detail below and shown in FIGS. 1A, 1B, 2A, 2B, 3A and 3B are brackets that can be ceiling mounted. Wall mounted brackets are shown in some of the drawings. The dual shade bracket will be described later.

Figure 1A:
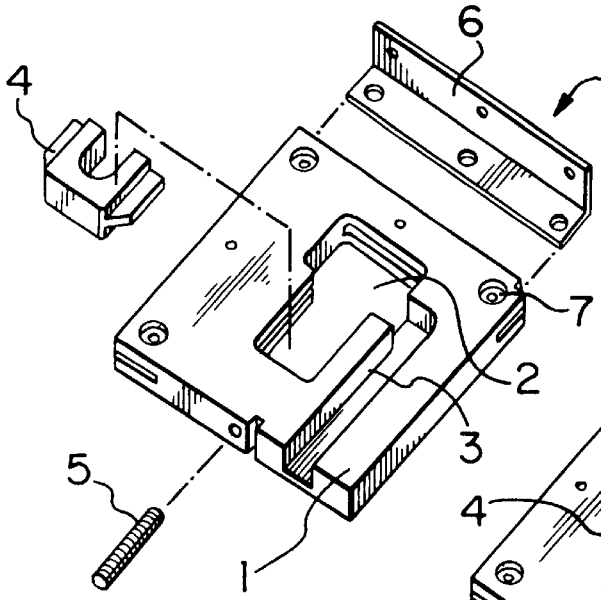
FIGS. 1A and 1B show an exploded perspective view and an assembled perspective view of the motor bracket.
Figure 1B:
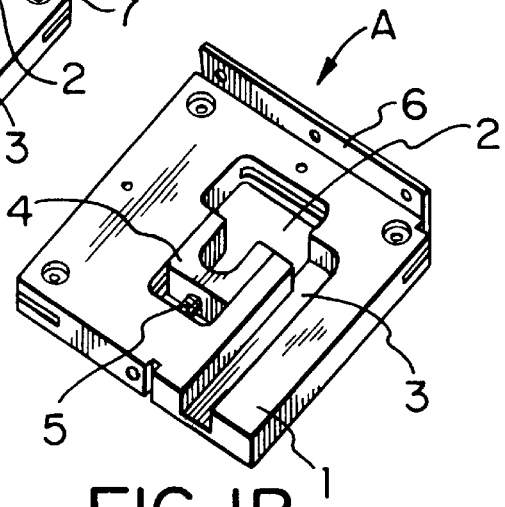

The end bracket A as shown in FIGS. 1A and 1B comprises an end unit 1 which is essentially square and about 16 mm thick. The central portion of the end unit 1 has a generally T-shaped cut out portion 2 formed in the central portion thereof. An elongated channel 3 is formed along side the T-shaped cut out portion 2. This elongated channel 3 allows for easy installing of the shade tube 13 or shade roller. A support pin 15 or idle end pin of the shade tube or shade roller enters the channel 3 from the bottom and slides up the channel 3 and then slides into a u-shaped support glide 4 where it rests. The u-shaped support glide 4 fits slidably into the T-shaped cut out portion 3. A threaded leveling screw 5 extends upward through the bottom of the end unit 1 into the cut out portion 3. The u-shaped support glide 4 rests on the threaded leveling screw 5. The threaded leveling screw 5 can be accessed from the bottom of the end unit 1 and is adjustable with an Allen key or screw driver.

Figure 8:
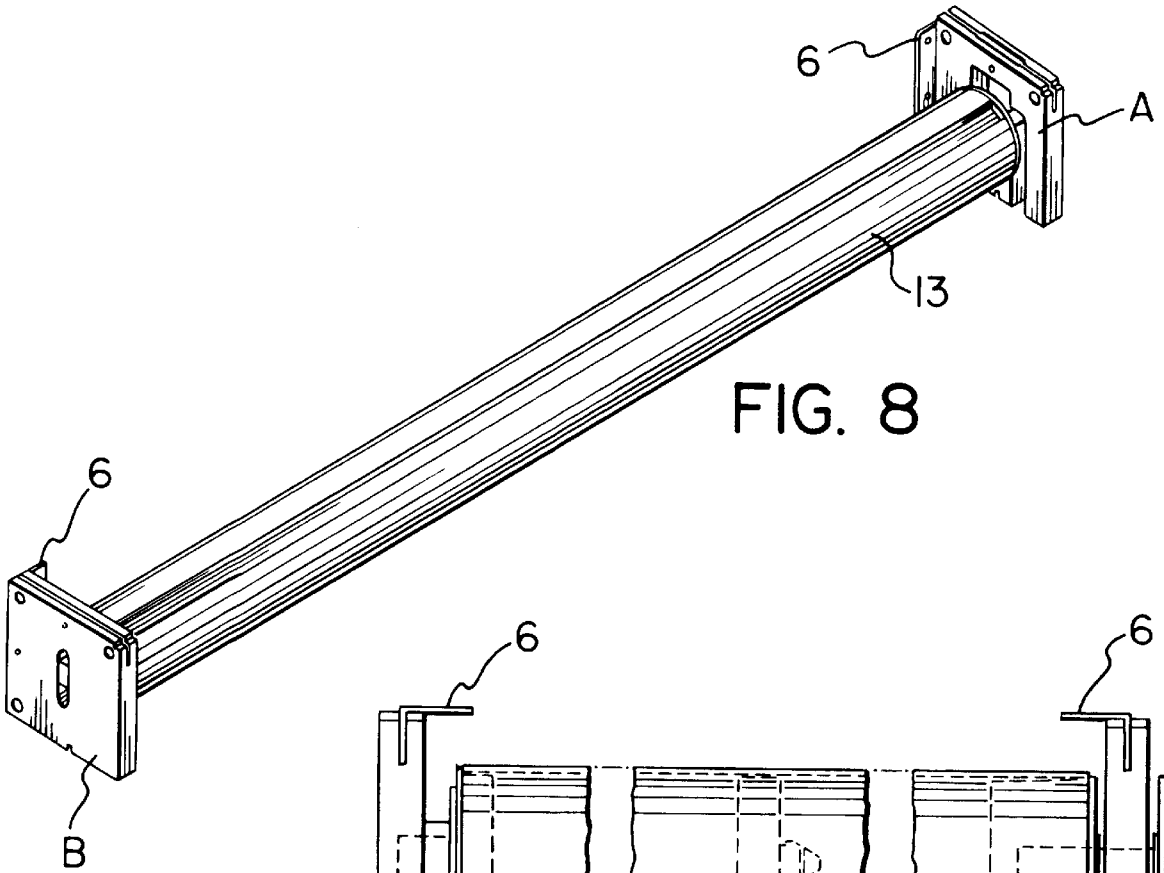
FIG. 8 is an assembly drawing showing a perspective view of the motor bracket and the end bracket as they will be used.

An angle 6 fits slidably into the top of the end unit 1 and can be secured to the end unit 1 by screws (not shown) through holes 7. For wall mounting the end unit 1 the angle 6 is slidably fitted along the side of the end unit 1 rather than along the top as shown in the figures. FIG. 8 shows the position of angle 6 for a wall or a window support structure mounting. The angle 6 is then affixed to the wall or ceiling using screws or other fastening means.

Figure 2A:
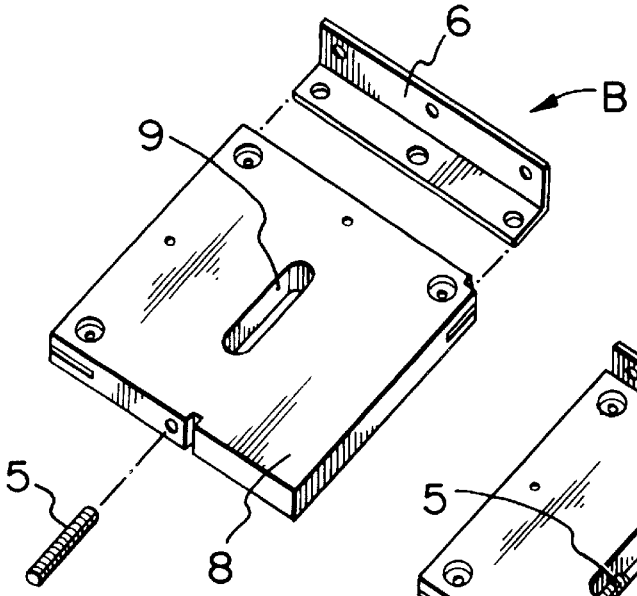
FIGS. 2A and 2B show an exploded perspective view and an assembled perspective view of the couple bracket.
Figure 2B:
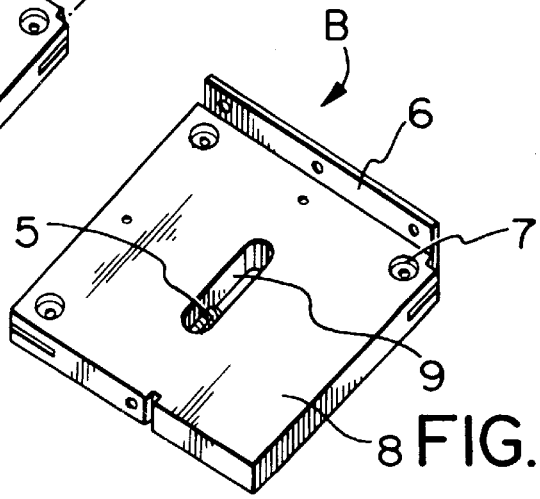

The motor bracket B as shown in FIGS. 2A and 2B comprises a unit 8 which is essentially square and of essentially the same size and thickness as the end unit 1 of the end bracket A. An elongated ellipse-shaped opening 9 is formed in the central portion thereof. An angle 6 can be fitted slidably into either the top or side of the unit 8 as in the end bracket A. A threaded leveling screw 5 extends upward through the bottom of the unit 8 into the opening 9. For a motorized shade operator the steel rod of the motor will engage with the leveling screw 5. The threaded leveling screw 5 can be accessed from the bottom of the motor bracket B and extends upward through the bottom of the motor bracket B into the elongated ellipse-shaped opening 9. The threaded leveling screw 5 can be adjusted in the same manner as detailed above.

Figure 3A:
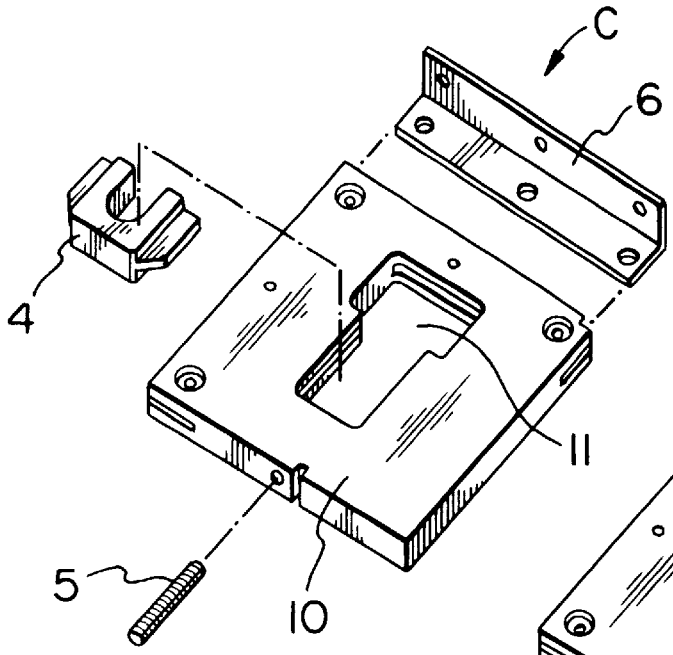
FIGS. 3A and 3B show an exploded perspective view and an assembled perspective view of the end bracket.
Figure 3B:
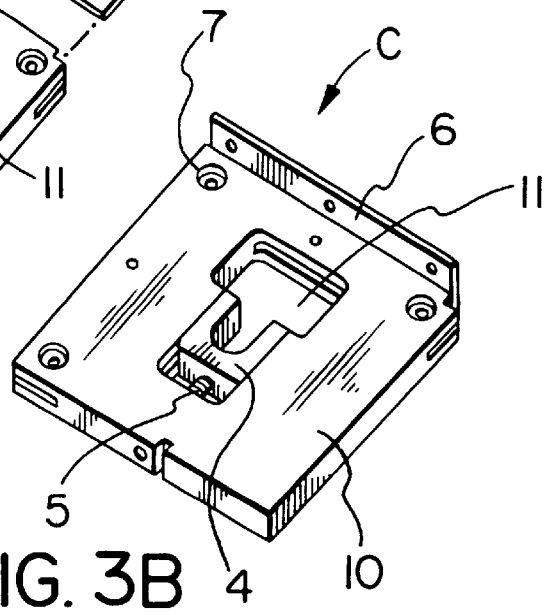
Figure 4:
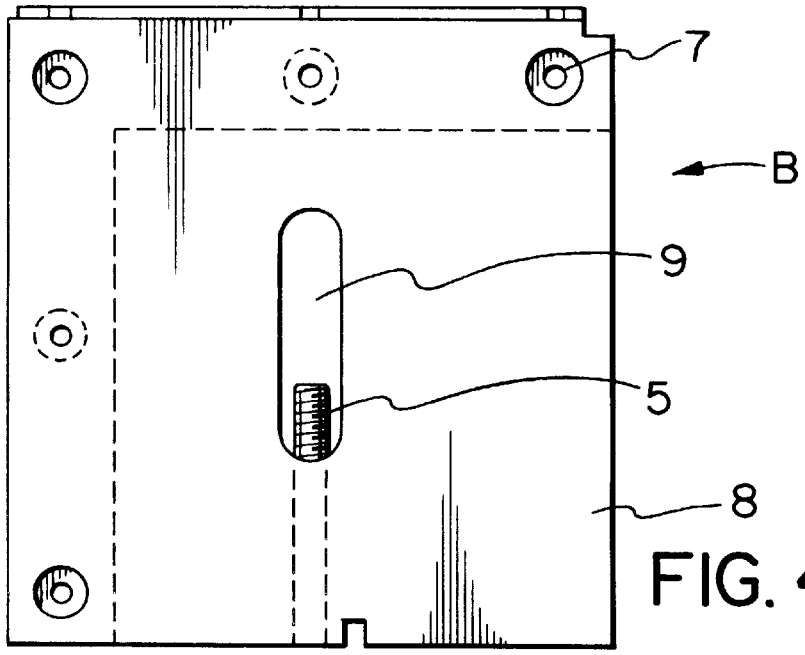
FIG. 4 shows a front view of an assembled motor bracket.
Figure 5:
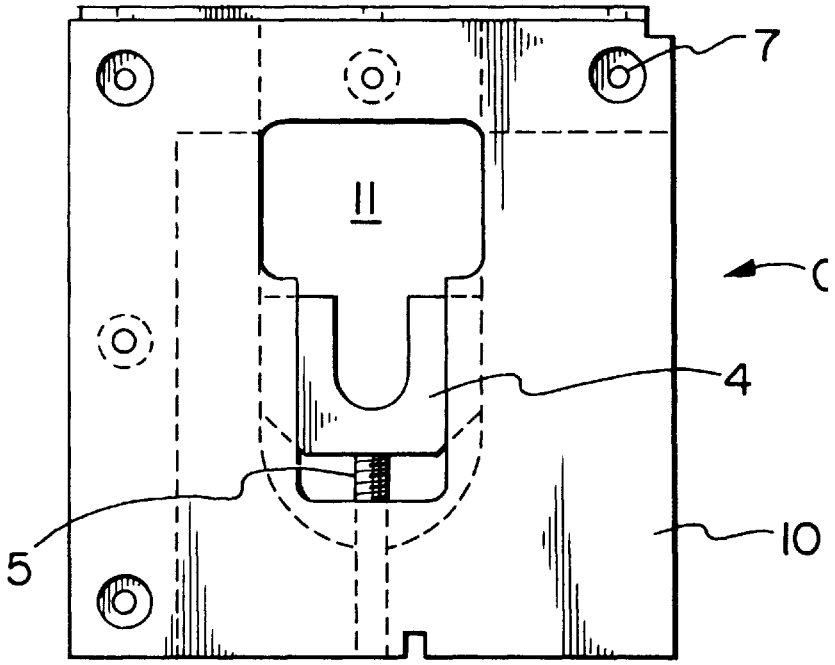
FIG. 5 shows a front view of an assembled couple bracket.
Figure 6:
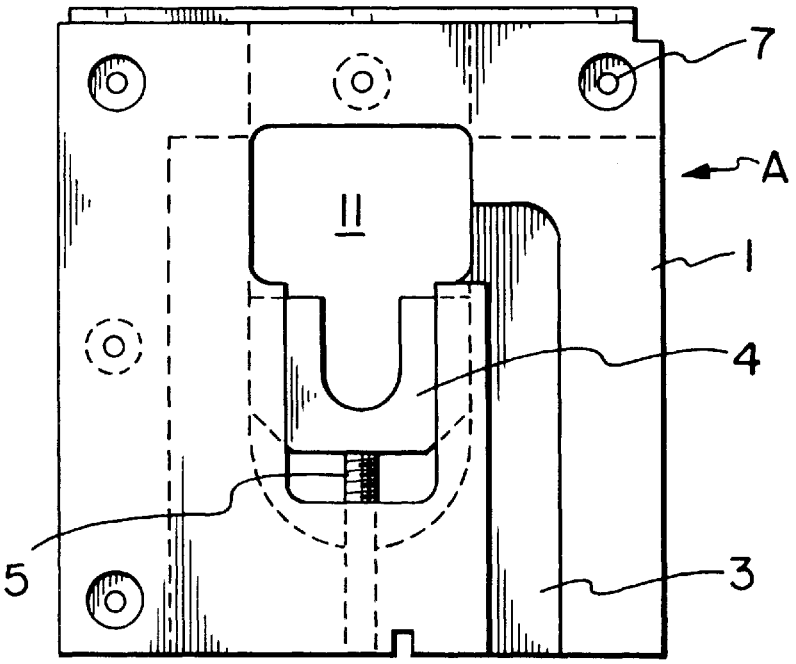
FIG. 6 shows a front view of an assembled end bracket.
Figure 7:
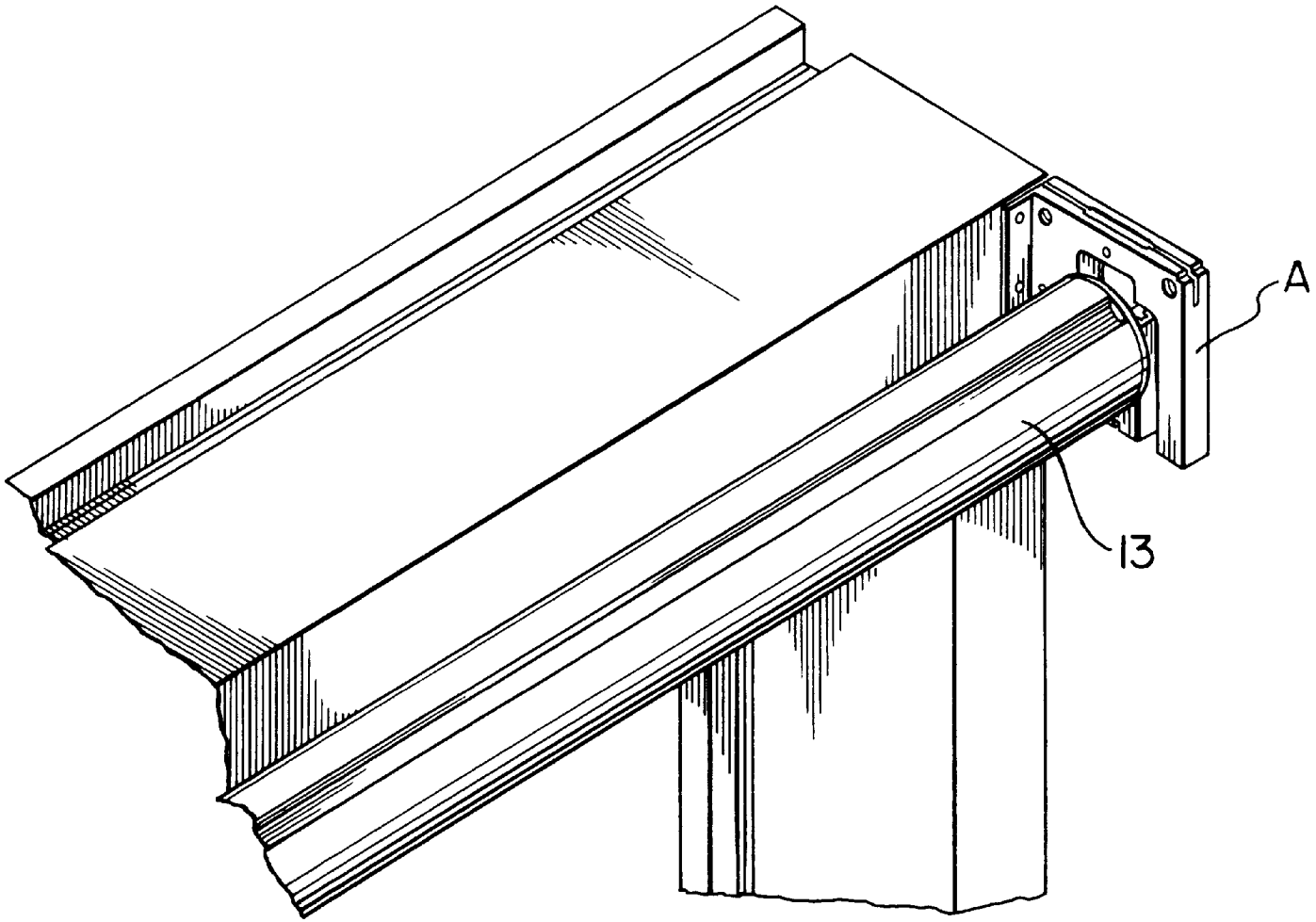
FIG. 7 is a perspective view showing the end bracket installed on a window frame and showing a shade roller.

The couple bracket C as shown in FIGS. 3A and 3B comprises an end unit 10 which is essentially square and of a size and thickness the same as the end unit 1 of the end bracket A. The central portion of the end unit 10 has a generally T-shaped cut out portion 11 that matches with the cut out portion 2 of the end unit 1. A u-shaped support glide 4 fits slidably into the T-shaped cut out portion 11. A threaded leveling screw 5 extends upward through the bottom of the end unit 10 into the cut out portion 11. The unshaped support glide 4 rests on the threaded leveling screw 5. The threaded leveling screw 5 can be accessed from the bottom of the end unit 10 and is adjusted in the same manner as described with respect to the end bracket A.

The three brackets described above can be used together to complete the bracket system of the present invention. If the shade is operated by hand cranking the motor bracket will be replaced with a standard crank operator bracket that generally does not have leveling capabilities. A standard crank operator bracket is not shown in any of the drawings. If the shade is operated by hand an end bracket and optionally one or more couple brackets may be used with the crank operator bracket in the same manner as described above and all leveling for the system is achieved at the end bracket and/or the couple bracket.

The bracket system of the present invention can comprise, at minimum, an end bracket A and a motor bracket B each affixed separately to the wall or ceiling by the angle 6. A central shaft 12 of a shade roller 13 rests on the u-shaped support glide 4. By adjusting the leveling screw 5 the height and level of the entire shade roller 13 can be adjusted.

Figure 9:
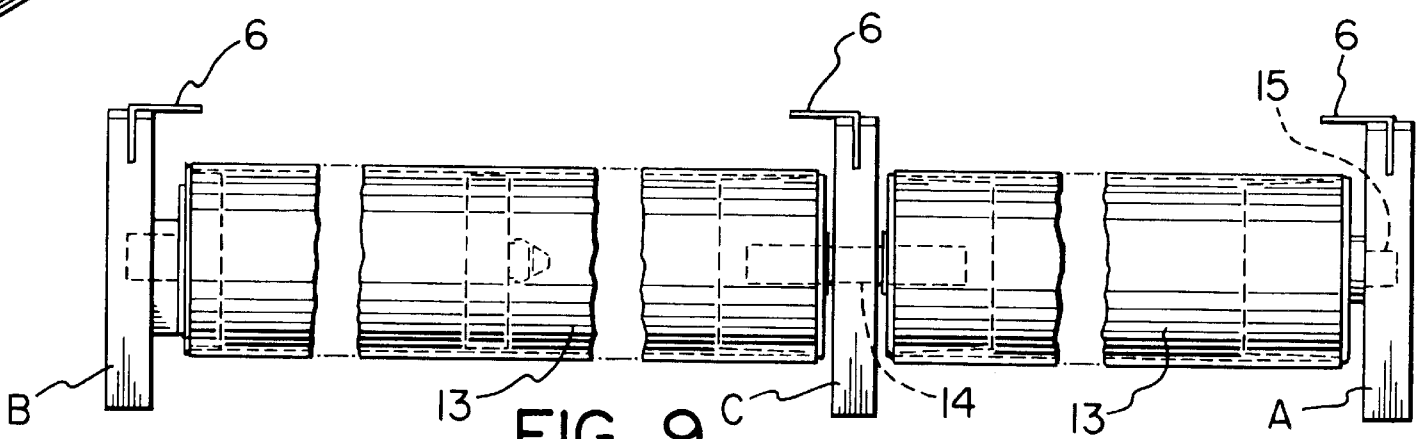
FIG. 9 is an assembly drawing showing a front view of the bracket system.
Figure 10:
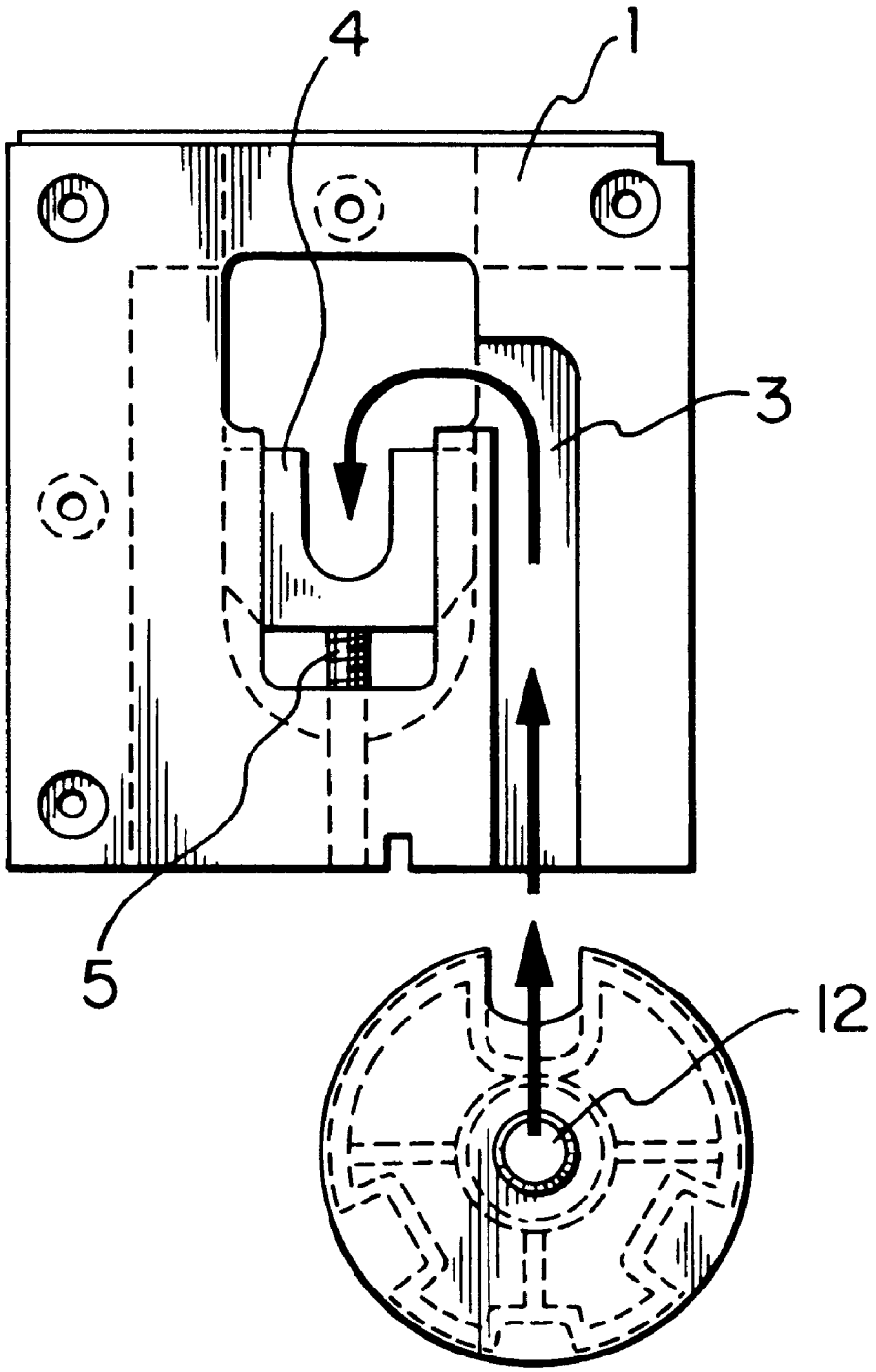
FIG. 10 shows the manner in which the shade roller is fitted into the end bracket.

Optionally, if site conditions permit, one or more couple brackets C may be affixed between the motor bracket B and the end bracket A. A couple pin 14 will rest on the u-shaped support glide 4 of the couple bracket and be inserted into two separate shade rollers so that one motor may be used to drive two or more shades. This is shown in the assembly drawing of FIG. 9.

Figure 11:
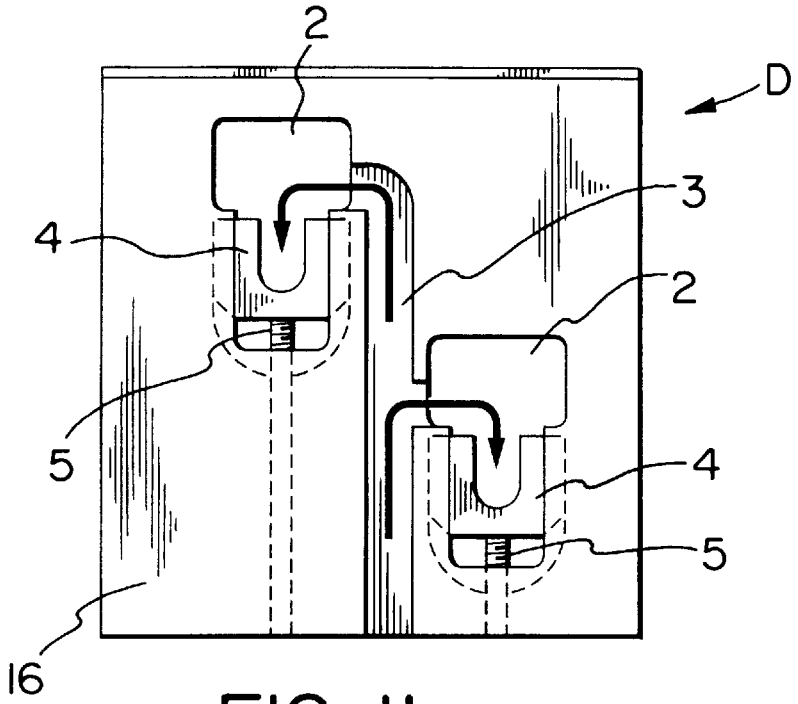
FIG. 11 shows a side view of the end bracket for a dual shade system.

The bracket system of the present invention can also be manufactured to support dual shades, for example, to support a blackout shade and a sunscreen shade. Likewise, it can support a decorative shade and a sunscreen or blackout shade. A bracket D for a dual shade system is shown in FIGS. 11 and 12.

The dual shade bracket D comprises a unit 16 which is essentially square and of essentially the same size and thickness as the end unit 1 of the end bracket A, the unit 8 of the motor bracket B and the unit 10 of the couple bracket C. The dual shade bracket D has two generally T-shaped cut out portions 2. One of the cut out portions 2 is located above and to the side of the other cut out portion 2. An elongated channel 3 is formed between the two cut out portions 2. This elongated channel 3 allows for the easy installation of the shade tubes 13. A u-shaped support glide 4 is slidably positioned into each of the two T-shaped cut out portions 2. A leveling means 5 extends upward through the bottom of the dual shade bracket D into each of the two T-shaped cut out portions 2. Each leveling means 5 can be adjusted in the same manner as those described above.

Figure 12:
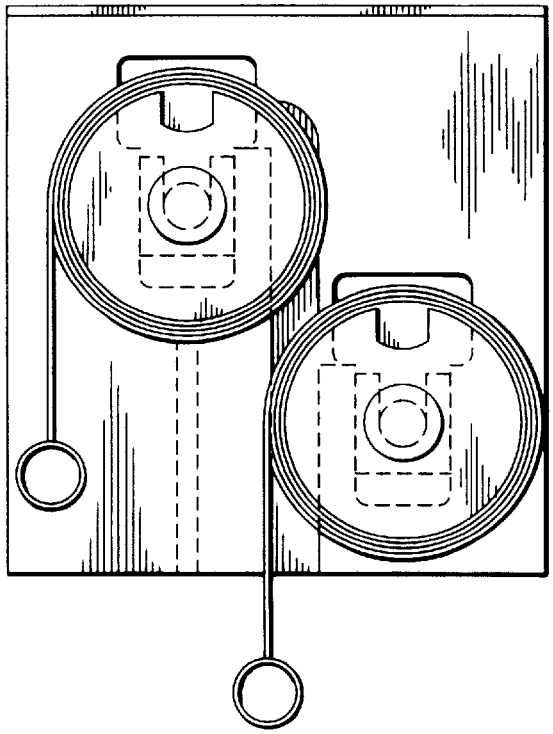
FIG. 12 shows a side view of the end bracket for a dual shade system with the shade tubes in place.

FIG. 12 shows the dual shade bracket D with the shade tubes 13 in place. The shade tubes 13 are parallel to each other with one positioned slightly above the other. The idle end pin or support pin 15 of each shade tube 13 rests on the u-shaped support glide 4. By adjusting the leveling means 5 each shade tube 13 can be leveled.

The angle 6 affixed to the wall or ceiling is generally made of metal, for example aluminum, and the end unit 1 of the end bracket A, the unit 8 of the motor bracket B, the unit 10 of the couple bracket C and the unit 16 of the dual shade bracket D are made of polyethylene. The u-shaped support glide 4 is also made of polyethylene.

Typically, the end bracket, the motor bracket, the couple bracket and the dual shade bracket of the present invention will be made in sizes of 100 mm, 125 mm and 150 mm. These are standard sizes used in the trade. The brackets can be custom made to any size to satisfy particular customer needs and site conditions.

If necessary, a additional central support bracket can be located midway between the two end brackets to ensure sufficient support of the shade rods. This would be necessary for very long or heavy shades.

The central support bracket is a standard bracket known in the trade with a hole drilled into the central portion of the bracket. The hole is of the same size as the diameter of the shade tube. The shade tube passes through the bracket which is then affixed to the wall or ceiling to provide extra support for the shade tube. The central support bracket has no leveling capabilities.

The bracket system of the present invention is suitable for use with both motorized shade operators as well as crank operated shades.

The device of the present invention is inexpensive and simple to manufacture being comprised of commonly used manufacturing materials and having no complicated or intricate parts. It can be easily installed and easily adjusted.

What is claimed is:

1. A shade bracket system comprising at least one first shade bracket comprising a wall or ceiling engaging member and a bracket member having at least one centrally located cut out portion into which is slidably located a vertically adjustable u-shaped glide and a second shade bracket comprising a wall or ceiling engaging member, a bracket member having a centrally located cut out portion and a leveling means.

2. A shade bracket comprising a wall or ceiling engaging member and a bracket member having at least one centrally located cut out portion into which is slidably located a vertically adjustable u-shaped support glide.

3. A shade bracket according to claim 2 wherein the centrally located cut out portion is generally T-shaped.

4. A shade bracket according to claim 2 wherein the u-shaped support glide is vertically adjustable with a leveling means.

5. A shade bracket according to claim 4 wherein the leveling means is a leveling screw.

6. A shade bracket according to claim 2 wherein the centrally located cut out portion is generally elongated ellipse-shaped.

* * * * *